US006308779B1

(12) United States Patent
McNeilly et al.

(10) Patent No.: US 6,308,779 B1
(45) Date of Patent: Oct. 30, 2001

(54) HYDRAULICALLY DRIVEN FISHING JARS

(76) Inventors: A. Keith McNeilly, 36 Parkway Cir., Houma, LA (US) 70364; Charles A. Roper, P.O. Box 1149, Pottsboro, TX (US) 75076

( * ) Notice: Subject to any disclaimer, the term of this patent is extended or adjusted under 35 U.S.C. 154(b) by 0 days.

(21) Appl. No.: 09/397,767

(22) Filed: Sep. 16, 1999

(51) Int. Cl.[7] ..... E21B 31/113
(52) U.S. Cl. ..... 166/301; 166/178; 175/297
(58) Field of Search ..... 166/301, 178; 175/296, 297, 300, 304

(56) References Cited

U.S. PATENT DOCUMENTS

| | | | | |
|---|---|---|---|---|
| 3,746,093 | | 7/1973 | Mullins . | |
| 4,356,867 | | 11/1982 | Carmody . | |
| 4,462,471 | | 7/1984 | Hipp . | |
| 4,878,550 | * | 11/1989 | Chuang | 175/296 |
| 5,052,485 | * | 10/1991 | Reid | 166/178 |
| 5,129,466 | | 7/1992 | Bartels et al. . | |
| 5,158,142 | | 10/1992 | Miszewski et al. . | |
| 5,170,847 | | 12/1992 | Mims et al. . | |
| 5,219,027 | | 6/1993 | Taylor . | |
| 5,318,139 | * | 6/1994 | Evans | 175/297 |
| 5,327,982 | | 7/1994 | Trahan et al. . | |
| 5,568,836 | | 10/1996 | Reid . | |
| 5,579,829 | | 12/1996 | Comeau et al. . | |
| 5,752,571 | | 5/1998 | Sapozhnikov . | |
| 5,787,982 | | 8/1998 | Bakke . | |
| 5,823,266 | | 10/1998 | Burleson et al. . | |
| 5,846,060 | | 12/1998 | Yoshimoto et la. . | |

FOREIGN PATENT DOCUMENTS

233038 * 8/1987 (EP) .

* cited by examiner

*Primary Examiner*—David Bagnell
*Assistant Examiner*—Zakiya Walker
(74) *Attorney, Agent, or Firm*—Bracewell & Patterson L.L.P.

(57) ABSTRACT

A fishing jar is placed in a work string for delivering blows to a stuck object in a well. This fishing jar utilizes energy stored in the work string for delivering the blow, rather than having a main spring of its own. The fishing jar uses hydraulic pressure to move a piston member. The piston member engages a firing member when it reaches one end of its stroke. The directional valve then directs fluid to the other side of the piston to cause the piston to move in the opposite direction. When it starts to move in the opposite direction, the firing member will provide a restrictive load against that movement. Once the pressure builds to a high enough level, it will move the housing relative to the piston, which is restricted from movement by the firing member. When the housing moves, it elastically deforms the work string, storing energy in the work string. The firing member will release the housing once the housing reaches the end of its stroke. The housing has a hammer surface that strikes an anvil once released.

25 Claims, 7 Drawing Sheets

HYDRAULICALLY DRIVEN FISHING JARS

TECHNICAL FIELD

This invention relates in general to oil and gas well downhole tools and particularly to a fishing jar tool that locates in a work string and is hydraulically driven for providing impacts to release a stuck object in the well.

BACKGROUND ART

In oil and gas well drilling operations, occasionally objects become stuck in the well. For example, the object, often referred to as a fish once stuck, might have been a tool lowered into the well on a wire line that became stuck on a ledge or a collapsed section of the well, preventing its retrieval. When this occurs, the operator releases the line from the object by parting it at a weak point. Then the operator runs back in the well with a working string that may be wire line, coiled tubing, threaded tubing or drill pipe to retrieve the object. Often, a set of jars will be located in the working string to provide impacts to the object to help retrieve the object.

Generally there are two types of jars in use, hydraulic release and mechanical release. A hydraulic release jar has an orifice within it and is filled with a liquid. It is operated by pulling tension on the work string and waiting for sufficient fluid to bypass internally to allow the jar to reach internal release position. The jar then rapidly opens several inches, and energy stored in the accelerator and/or the tubing string is imparted to the engaged object. The operator then slacks off tension in the work string to repeat the cycle. The operator can vary the release tension without retrieving and adjusting the tool. However, hydraulic release jars are relatively expensive and not very dependable. They have a tendency to become contaminated by wellbore environments due to the high internal pressure differentials inherent to their operation.

Mechanical release jars, while being more dependable, must be adjusted on the surface to the anticipated release tension prior to being run in the hole. If these jars are set to a release tension which cannot be attained upon downhole engagement, or if the tension proves to be too low to be effective, the work string must be disengaged, pulled out of the hole, and readjusted.

Both types require a recocking by movement of the work string. This involves lowering work string tension at the tool to zero, then applying enough weight to overcome any inherent resistance to recocking in the tool. Other than observation of a weight indicator, there is no surface indication that recocking has occurred. If hydraulic release jars are being used, which are time delay devices, much time can be consumed waiting for jars to fire which have not been recocked. Further, operators tend to apply more weight than required during recocking to insure recocking occurs. There are two hazards in this practice. Applying weight at the fishing tool may cause the fishing tool to become disengaged, especially with a ratchet type mechanism. Also, downward firing jars may be fired inadvertently, applying unwanted or destructive down shock loads to the fishing tools or fish.

A major disadvantage of recocking the types of tools described above is the requirement for moving the work string up and down for each impact. Hundreds of jarring cycles may be needed before a fish release is obtained. If surface pressure is present, packoff devices must be stripped through each time the tool is cycled. If coiled tubing is used as the work string, correlation between depth and weight is easily lost. Wrapping and unwrapping of tubing on the reel, and variations in reel tension and friction in pressure control devices affect weight indicator readings and create uncertainty. The repeated cycles of wrapping and unwrapping of the coiled tubing cause fatigue and wear on the coiled tubing.

As mentioned above, the work string may be wire line, coiled tubing, threaded tubing, or drill pipe. In wells that are highly deviated, wire line will not function. Also, if circulation or high tensile loads are required, wire line is unacceptable. Coiled tubing has an advantage over threaded tubing and pipe because it is faster to rig-up and trip. If well pressure exists, surface pressure control is much less complex and more dependable with coiled tubing. The internal passage of coiled tubing is never exposed to the atmosphere because no making and breaking of connections is required. The operator can pump through coiled tubing at any time during the operation, even during tripping. The disadvantage of coiled tubing, as mentioned above, is the bending and straightening that occurs while the jar is being recocked. This bending and straightening induces fatigue, which accumulates locally until the tubing fails by breaking. Larger OD coiled tubing may fail with as few as thirty cycles. Common size coiled tubing, 1¼ to 1½ inch, are limited to less than 200 cycles before failure. Even if the fish is retrieved prior to catastrophic failure, accumulated localized fatigue remains in the affected section of the work string. When coiled tubing fails during a workover operation, many problems, some of which may be dangerous, result. In any case, considerable time and expense are incurred in removing parted coiled tubing from a well. Because of the fatigue problem, if high tensile loads are required during a fishing operation, operators generally will not use larger OD coiled tubing and use threaded tubing, even though more time consuming.

One type of jar shown in prior patents does not require cycling of a work string to recock the jar. This tool is driven by hydraulic fluid pressure pumped down from the surface. In this type of jar, the liquid pumped down the string will cause a piston to move, compressing a main spring. When the spring is fully compressed, the piston is released with the main spring delivering an impact. This type avoids having to move a string of coiled tubing back and forth for each impact. However, it relies on the force of the main spring to deliver the impact, which may not be adequate in some cases.

SUMMARY OF THE INVENTION

The fishing jar of this invention is driven by hydraulic fluid pressure supplied down the work string, however it does not require a main spring for providing the energy for the blow. Instead, it stores energy in the work string, preferably a string of coiled tubing. Also, the tool will deliver either downward impacts or upward impacts without retrieving the tool to the surface.

The jar has a housing with a hammer surface, preferably at a lower end. The upper end of the housing connects to the work string. A mandrel is located at the lower end of the housing, the lower end of the mandrel being connected to a fishing tool that engages the stuck object in the well. The mandrel has an anvil positioned to be impacted by the hammer surface of the housing. A piston is carried reciprocally in the housing. A firing member is also located in the housing. A directional valve mounted in the piston causes the piston to stroke between upper and lower positions.

In the case of upward delivery of impacts, the operator applies a selected amount of tension to the work string, then holds the work string stationary and pumps a liquid such as water down the work string. The directional valve supplies hydraulic fluid from the surface to the upper side of the piston to push it downward into engagement with the firing member. Once in engagement, the directional valve directs hydraulic fluid pressure to the lower side of the piston, causing it to move upward in the housing. The firing member applies a restrictive load to this upward movement. Once the piston reaches a certain point, continued hydraulic pressure will move the housing downward relative to the mandrel and stuck object, applying additional tension to the work string, thereby storing energy in the work string. The piston and firing member will subsequently reach a point that releases the piston member, which allows energy stored in the work string to rapidly move the housing back upward, causing its hammer surface to strike the anvil. Throughout the jarring operation, the operator at the rig floor will maintain the work string at a stationary point because cycling is not required. For downward impacts, the operation described above will be in reverse.

BEST MODE FOR CARRYING OUT THE INVENTION

Figure 1A:
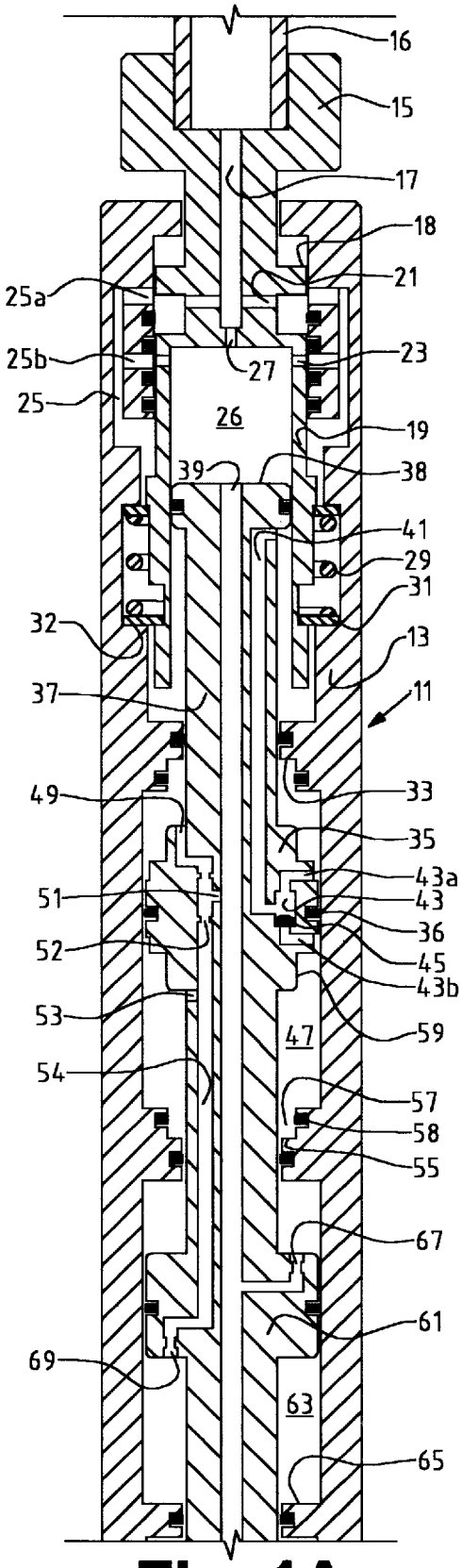
FIGS. 1A and 1B comprise a schematic vertical sectional view of a fishing jar constructed in accordance with this invention.
Figure 1B:
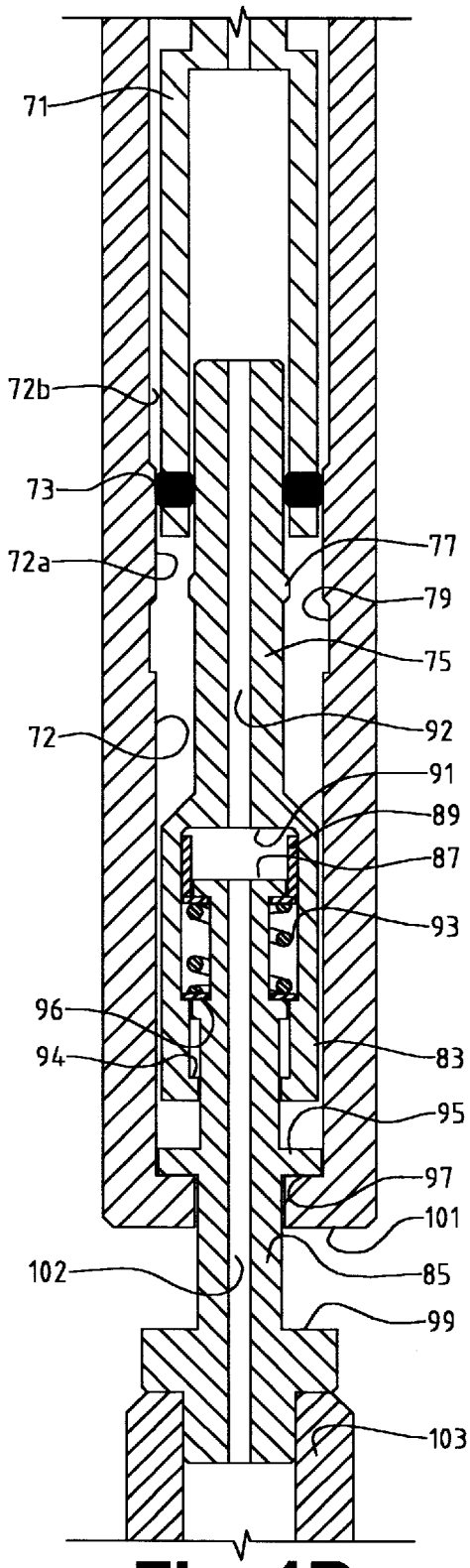
Figure 2:
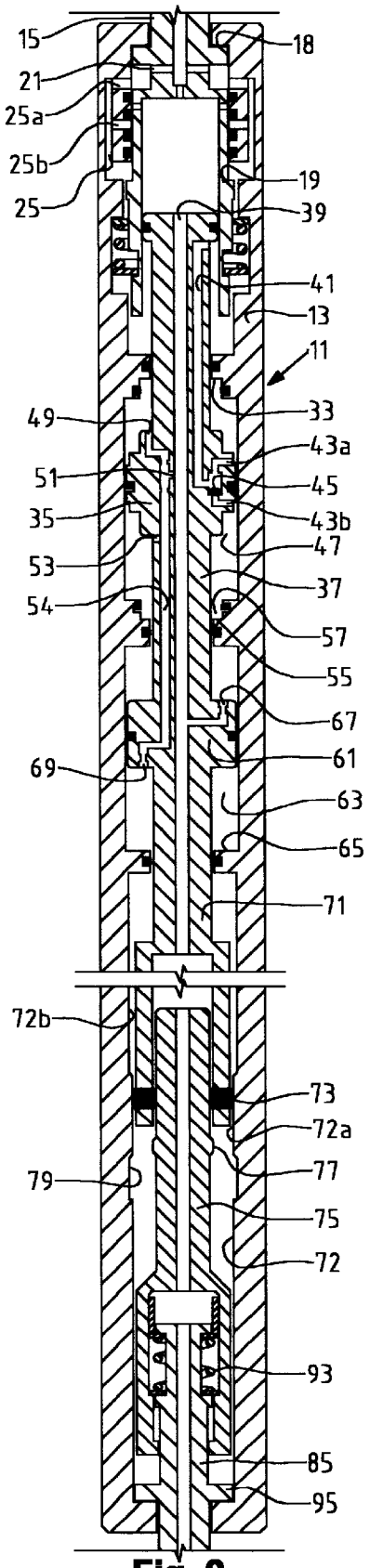
FIG. 2 is a view of the fishing jar of FIG. 1, shown with tension applied and hydraulic fluid being pumped down the work string to cause the piston to move downward to cock.
Figure 3:
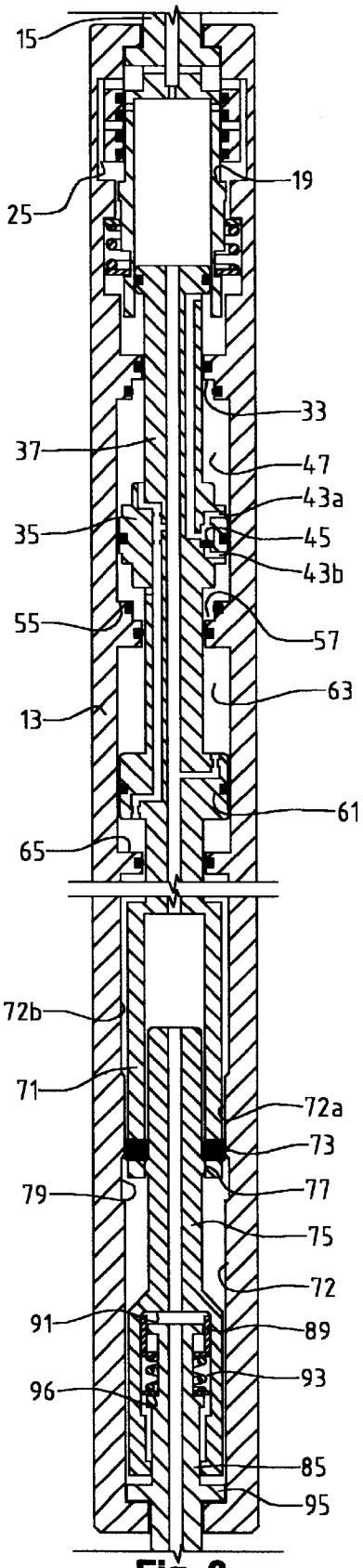
FIG. 3 is a view of the fishing jar similar to FIG. 2, showing the piston near the end of its cocking stroke.

Referring to FIGS. 1A, 1B, jar assembly 11 has a tubular housing 13. An adapter 15 extends through the upper end of housing 13 and secures to a tubular work string such as coiled tubing 16. Adapter 15 has a flange 18 on its lower end, carried within housing 13. Adapter 15 is able to move up and down a short distance relative to housing 13 for controlling the mode of operation of jar 11. FIG. 1A shows adapter 15 in a neutral position relative to housing 13 and FIG. 2 shows adapter 15 in an upper position, with flange 18 abutted against a shoulder of housing 13. Adapter 15 has an axial passage 17 extending through it for the passage of a hydraulic fluid, normally water being pumped down coiled tubing 16.

A tubular control valve 19 is connected to adapter 15 for movement therewith and extends downward from flange 18. Control valve 19 is a sleeve having an upper lateral passage 21 leading radially outward from axial passage 17. Control valve 19 also has a lower lateral passage 23 that leads outward from axial passage 17. Both passages 21, 23 lead to an annular bypass passage 25 formed in the housing. Bypass passage 25 has an upper port 25*a* and a lower port 25*b*, ports 25*a* and 25*b* being spaced apart from each other the same distance as control valve lateral passages 21 and 23. In response to movement of coiled tubing 16, valve 19 moves between an upper position (FIGS. 2–7), a neutral position (FIGS. 1A and 8) and a lower position (FIG. 9–14). While in the neutral position of FIG. 1A, fluid pumped down passage 17 will flow out upper lateral port 21 into bypass port 25*a*, through a portion of bypass 25, back into bypass port 25*b*, and into a chamber 26 in valve 19. When valve 19 is in the upper position shown in FIGS. 2–7, port 23 is blocked, therefore fluid cannot flow into chamber 26 within valve 19. Valve 19 also has a lower position, which is shown in FIGS. 9–14 and is utilized when the tool is delivering downward impacts. In the lower position, hydraulic fluid flows out upper port 21 through bypass port 25*b* into bypass passage 25. The lower position of valve 19 delivers fluid down annular bypass passage 25 in the same manner as the upper position shown in FIGS. 2–7.

Control valve 19 also has a restrictive orifice 27 that allows some flow-by from axial passage 17 into chamber 26, which is a low pressure chamber in all modes of operation. A coil spring 29 contacts a flange 31 secured to valve 19 to urge valve 19 downward to the neutral position of FIG. 1A. In this neutral position, flange 31 lands on a shoulder 32 formed in the housing 13, preventing filter downward movement of valve 19 unless pushed downward with adapter 15. Flange 31 does not form a seal on shoulder 31, rather passages are formed in flange 31 to enable fluid to flow down bypass 25 completely to the lower end of valve 19 in this annular space. Control valve 19 thus directs hydraulic fluid pressure to an outer annular space surrounding it when in an operational mode, either for upward or downward blows, and when in the neutral mode, directs the fluid into low pressure chamber 26.

An upper partition 33 is formed in housing 13. A master piston 35 reciprocates below upper partition 33. Master piston 35 has a seal 36 and is larger diameter than the inner diameter of upper partition 33. Master piston 35 is mounted to a shaft 37 that has an upper portion extending upward from master piston 35 and sealingly engaged by seals at upper partition 33. Shaft 37 extends upward into valve chamber 26 and has a flange 38 with seals on its upper end that sealingly engage inner diameter of control valve 19. Shaft 37 has an axial passage 39 that extends through it and communicates with low pressure chamber 26. The seals on the flange 38 of master piston extension 37 prevent high pressure fluid in the bypass passage 25 from entering low pressure chamber 26. Shaft 37 has an axial entry flow passage 41 that is parallel to passage 39 and has an inlet just below flange 38 to bypass passage 25. High pressure fluid in bypass passage 25 flows around shaft 37 and through entry flow passage 41 downward to a directional passage 43.

Directional passage 43 is a chamber that contains a shuttle valve or ball 45. Directional passage 43 has an upper outlet 43*a* and a lower outlet 43*b*. While in the lower position shown in FIG. 1A, ball 45 seats against outlet 43*b*, preventing high pressure fluid from flowing through outlet 43*b*, yet allowing high pressure fluid to flow through outlet 43*a*. When ball 45 moves to the upper position shown in FIGS. 4–7, it seats against upper outlet 43*a* and allows high pressure fluid to flow out outlet 43*b*.

Directional passage 43 is located in master piston 35, with upper outlet 43*a* located above the piston seals and lower outlet 43*b* locates below the seals of master piston 35. The seals of master piston 35 seal within housing 13 in a chamber 47. Master piston 35 also has an upper vent passage 49 that communicates with the upper portion of chamber 47 above its seals. Upper vent passage 49 leads downward to a vent 51 that communicates with axial passage 39. There is a restrictive orifice 52 located between vent passage 49 and vent 51. On an upstroke, fluid contained in the upper portion of chamber 47 above master piston 35 vents through vent port 49, restrictive orifice 52 and out vent 51 into axial passage 39, which is at low pressure.

A communication port 53 is located in shaft 37 directly below master piston 35. Communication port 53 connects the lower portion of chamber 47 with a passage 54 that to extends downward through shaft 37. Another partition 55 forms the lower end of chamber 47. Partition 55 is similar to partition 33, but inverted.

Figure 7:
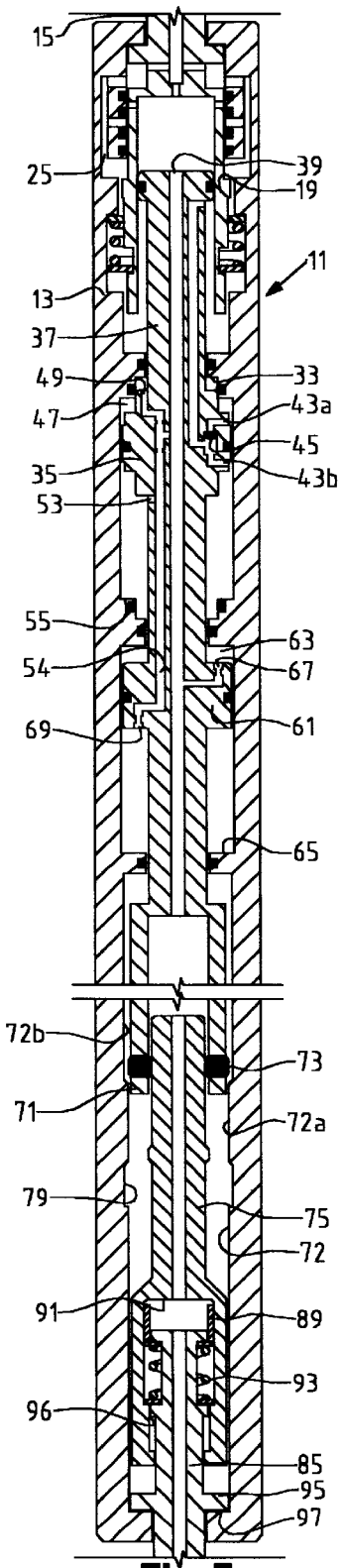
FIG. 7 is a view of the fishing jar similar to FIG. 6, showing the tool after the firing pin has released the piston and the housing has rapidly moved back up and delivered a blow to the anvil.

Each partition 33, 55 has a counterbore 57 of larger diameter than the diameter of shaft 37. Counterbores 57 face each other into chamber 47 for closely receiving a neck portion 59 on the upper and lower ends of master piston 35. Neck portions 59 are smaller in diameter than the bore of chamber 47, but are sized to sealingly fit within counterbores 57, which contains seals 58. When the lower neck 59 enters the counterbore 57 of partition 55, hydraulic fluid in this portion of chamber 47 is trapped between seal 58 of counterbore 57 and seal 36 on piston 35. Further movement of piston 35 toward partition 55 creates higher pressure than exists on the upper side of piston seal 36, which causes shuttle valve 45 to shift to the upper position as can be seen by comparing FIGS. 3 and 4. Also, seal 58 in counterbore 57 provides a fluid cushion for piston 35, preventing it from directly contacting partitions 33 and 55 between its strokes. Similarly, when master piston 55 is in an upstroke and approaching upper partition 33, the trapped fluid between seal 58 of counterbore 57 and seal 36 on piston 35 will increase the pressure in upper port 43*a* to an amount greater than the pressure in chamber 47 below piston seal 36, causing valve 45 to move back to the lower position shown in FIG. 1A. FIG. 7 shows master piston 35 approaching upper partition 33, with valve 45 in the upper position. FIG. 2 illustrates valve 45 shifted back to the lower position and master piston 35 moving downward again.

A lower or slave piston 61 is also connected to shaft 37 for movement therewith. Slave piston 61 locates below intermediate partition 55 and is sealingly carried in a chamber 63. The lower end of chamber 63 is defined by a lower partition 65. Slave piston 61 is similar to master piston 35, however it does not have a directional valve 45. Also, slave piston 61 is used only for assisting piston 43 in one direction, which is in the upward stroke. In this embodiment, piston 61 is not supplied with hydraulic fluid pressure for assisting the downward stroke of master piston 35, rather it is supplied with hydraulic fluid pressure only for assisting master piston 35 on the upward stroke. This function is handled by an upper vent port 67 in slave piston 61, which leads from axial passage 39 to the upper portion of chamber 63. There is a restricted orifice (not shown) at upper vent port 67. Similarly, piston 61 has a lower port 69 that extends from communication passage 54 to the lower portion of chamber 64 below the seals of piston 61. On the upstroke, high pressure fluid in upper chamber 47 below master piston 35 communicates with chamber 63 below piston 61 via port 53, passage 54 and port 69. A restrictive orifice also exists at port 69, however, it does not prevent high pressure fluid from flowing outward into lower portion of chamber 63. On the upstroke, fluid contained within the upper portion of chamber 63 above slave piston 61 vents through vent port 67 into axial passage 39 in shaft 37. On the downstroke, fluid in chamber 63 vents through ports 69, passage 54 and port 51 into passage 39. Additional slave pistons may be incorporated for assistance during the upward stroke as shown in the embodiment of FIG. 15. If desired, slave piston 61 could be supplied with hydraulic fluid pressure both on the downward and upward strokes, rather than just on the upward stroke.

Shaft 37 has a lower extension 71 formed on its lower end, lower extension 71 being a sleeve. Lower extension 71 has a smaller outer diameter than the inner diameter of housing bore 72 below partition 65. It does not operate as a piston. Lower extension 71 has a plurality of pins 73 that are mounted in its sidewall near the lower end. Pins 73 are loosely carried in the sidewall of lower extension 71 so that they are able to move radially between inner and outer positions. In the position shown in FIG. 1B, pins 73 are in an inner position, with their outer ends engaging a reduced diameter portion 72*a* of bore 72. FIG. 7 shows pins 73 moved to an outer position with their outer ends engaging a larger diameter portion 72*b* of bore 72, located above restricted bore portion 72*a*.

Figure 4:
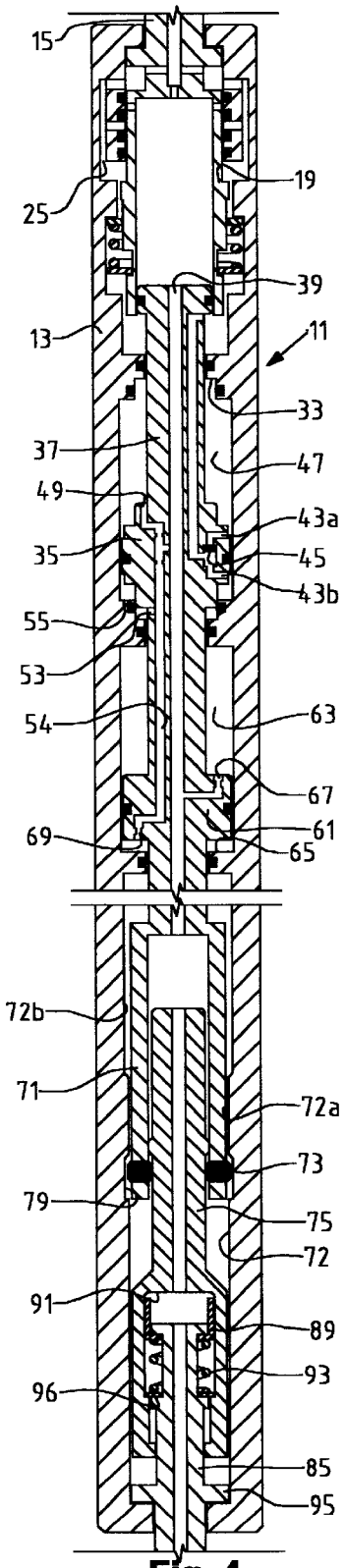
FIG. 4 is a view of the fishing jar similar to FIG. 3, showing the directional valve shifted to the opposite position, with fluid pressure now being delivered to move the piston upward along with the firing pin.
Figure 5:
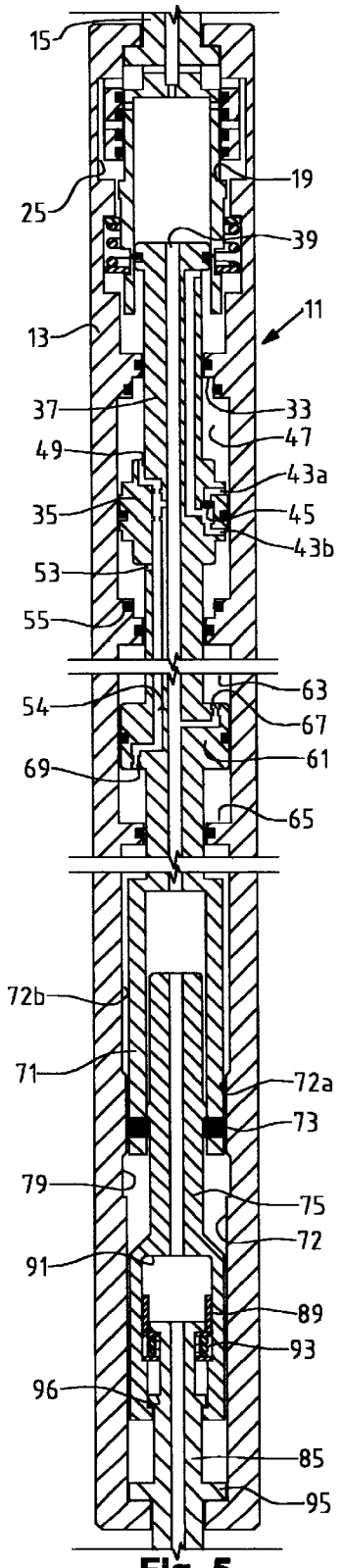
FIG. 5 is a view of the fishing jar similar to FIG. 4, showing hydraulic pressure still being applied to the lower side of the piston, but the firing pin being located at its uppermost point, with its cocking spring fully compressed.
Figure 6:
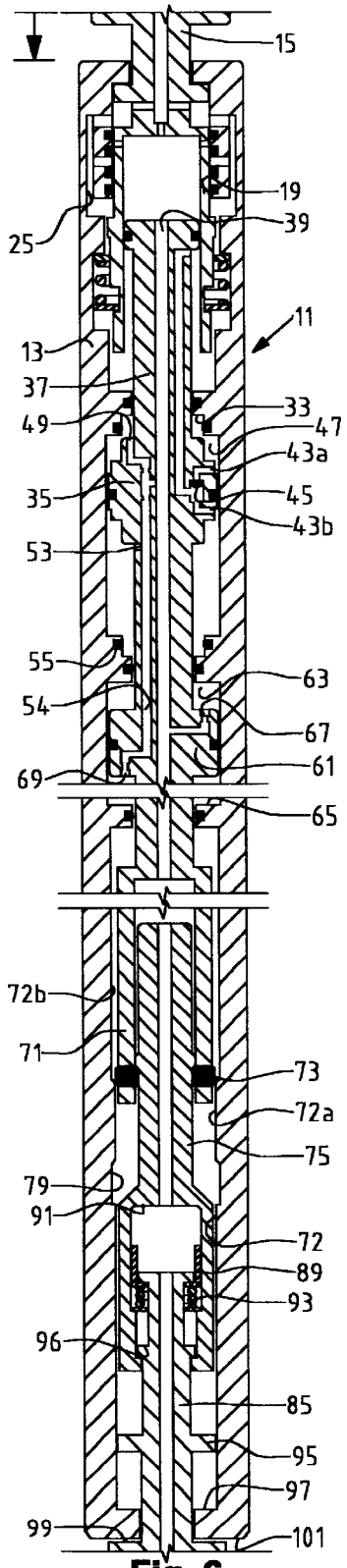
FIG. 6 is a view of the fishing jar similar to FIG. 5, showing that further hydraulic fluid pressure on the piston causes the housing to move downward, stretching the work string and storing energy in the work string.

The inner ends of pins 73 slidingly engage an upper cylindrical portion of a firing pin 75. Firing pin 75 has an annular protruding rib 77 that is engaged by pins 73 while pistons 35, 61 are stroked. In the position shown in FIG. 1B, pins 73 are located above rib 77 while FIGS. 4–6 show pins 73 located below rib 77. On the downstroke, pins 73 are able to slide over rib 77 when they reach a bore recess 79. Recess 79 is located below bore restricted portion 72*a* and allows pins 77 to move outward. Restricted bore portion 72*a* prevents any outward radial movement of pins 73, either inward or outward. Enlarged bore portion 72*b* allows outward movement of pins 73, allowing rib 77 to slip past for firing, which can be seen by comparing FIGS. 6 and 7.

Firing pin 75 has a sleeve 83 on its lower end that receives within it an upper portion of a mandrel 85. Mandrel 85 has an upper flange 87 located within firing pin sleeve 83. A spacer 89 extends around flange 87 to limit downward movement of firing pin 75 relative to mandrel 85. While in the position shown in FIG. 1B, spacer 89 abuts a downward facing shoulder 91 of firing pin 75. Firing pin 75 has an axial passage 92 that communicates with axial passage 39 in shaft 37. Sleeve 83 of firing pin 75 has a upward facing shoulder 94 that is contacted by a flange 96 on mandrel 85 when filing pin 75 is in the upper position relative to mandrel 85, as shown in FIG. 5.

Figure 12:
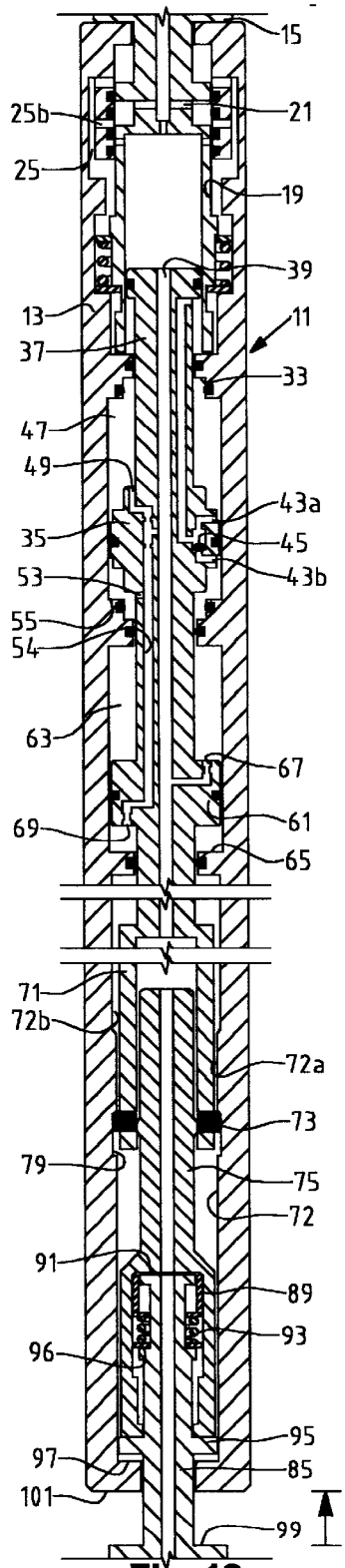
FIG. 12 is a view of the fishing jar similar to FIG. 11, showing the firing pin at the bottom of its stroke with the hydraulic pressure pushing the housing upward and applying further compression to the work string.
Figure 13:
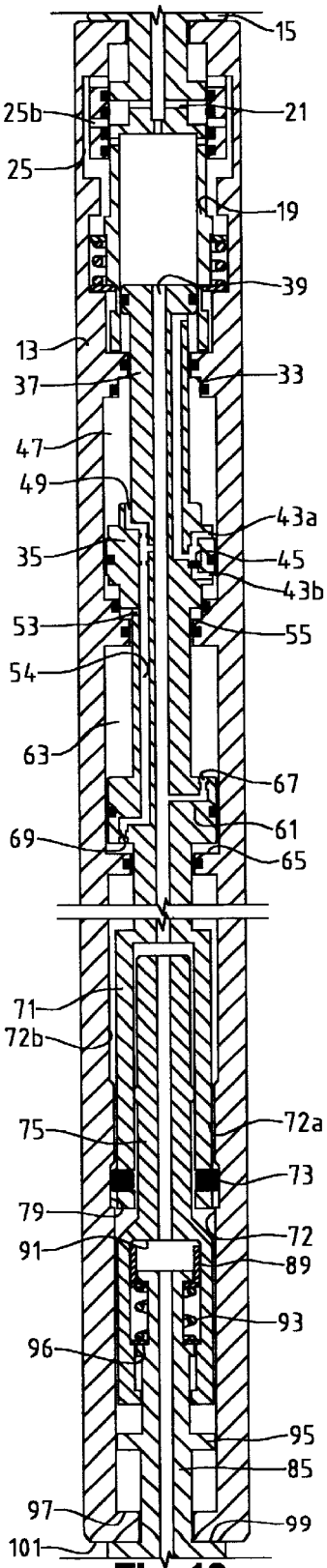
FIG. 13 is a view of the fishing jar similar to FIG. 12, showing the jar immediately after firing, with the housing hammer surface applying a downward blow to the mandrel anvil.
Figure 14:
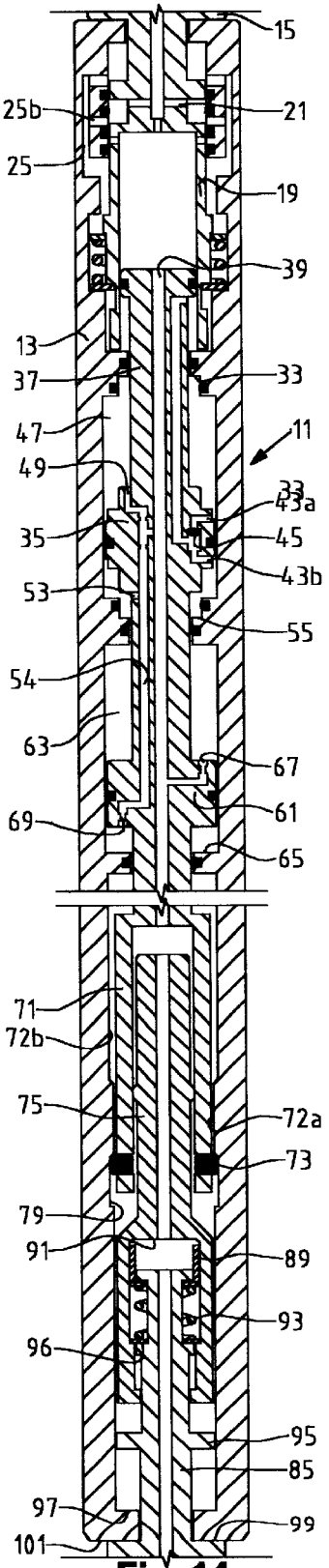
FIG. 14 is a view of the fishing jar similar to FIG. 13, showing the directional valve moved back to the other position for repeating the cycle.
Figure 15A:
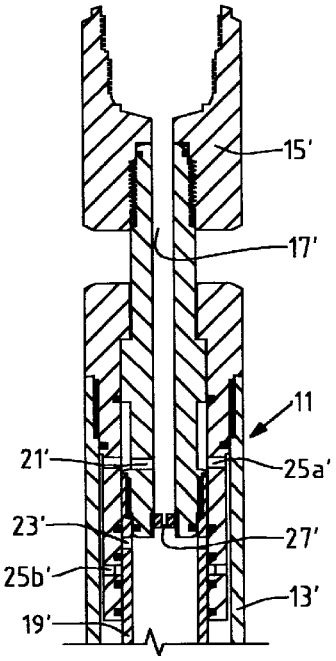
FIGS. 15A, 15B, 15C and 15D comprise a vertical sectional view of an alternate embodiment of a fishing jar constructed in accordance with this invention.
Figure 15B:
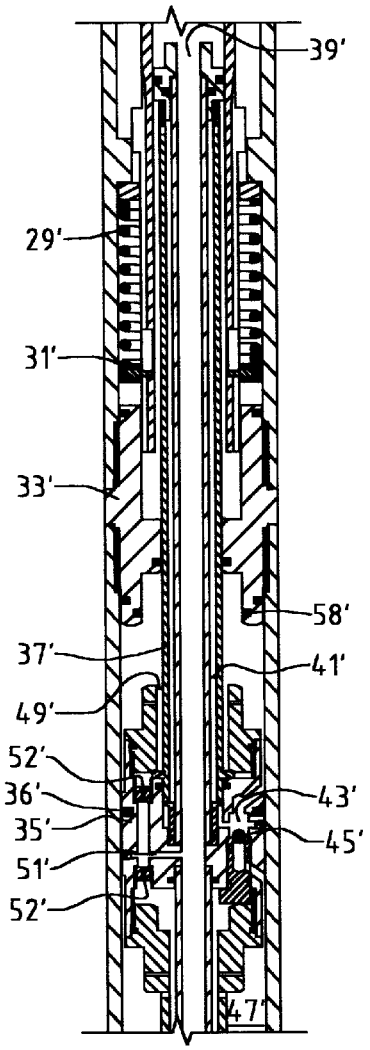
Figure 15C:
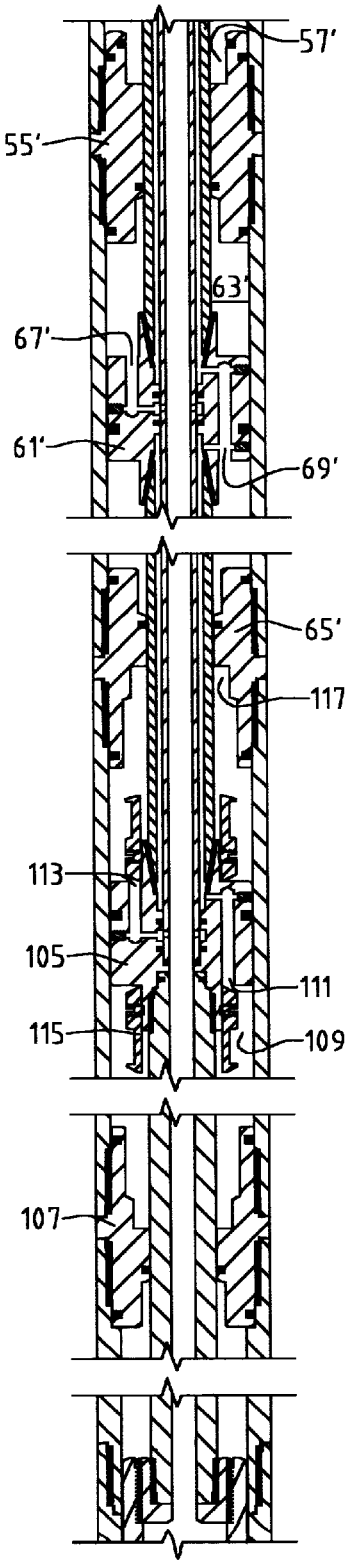
Figure 15D:
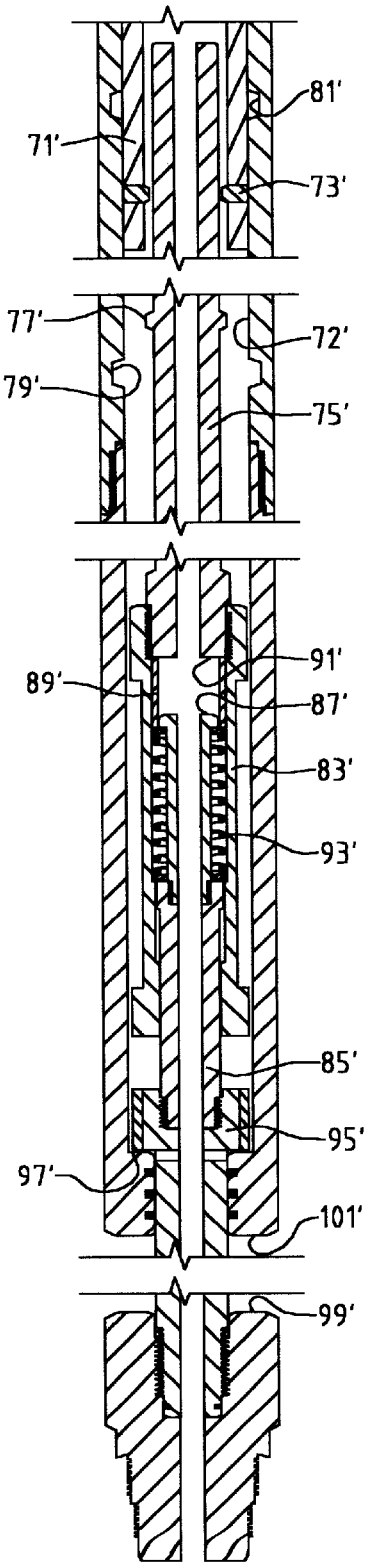

A coil spring 93 has an upper end in contact with spacer 89 and a lower end in contact with an upward facing shoulder formed in the interior of sleeve 83. The lower end of spring 93 also is supported by mandrel flange 96 in certain positions during downward firing mode, such as in FIG. 12. Spring 93 urges firing pin 75 to a neutral position relative to mandrel 85, shown in FIG. 1B, with spacer 89 substantially in contact with shoulder 91. FIGS. 5 and 6 show firing pin 75 in an upper position relative to mandrel 85, with spring 93 compressed and flange 96 in contact with flange 94. FIG. 12 shows firing pin 75 in a lower position relative to mandrel 85, with spring 93 compressed and the lower end of firing pin sleeve 83 in engagement with mandrel flange 95.

Mandrel 85 has an upper anvil 95 that is carried within bore 72 of housing 13 below firing pin sleeve 83. Housing 13 has an upward facing hammer surface 97 on its lower end that strikes anvil 95 when delivering upward blows. Preferably, mandrel 85 also has a lower anvil 99 located below housing 13. Anvil 99 is a radially extending flange. Housing 13 has a downward facing hammer surface 101 on its lower end for delivering a blow to lower anvil 99 for downward strokes. Mandrel 85 is shown attached to a fishing tool 103 which may be of conventional design for engaging a stuck object.

Upward Blow Operation

In operation for the upward blow mode, jar assembly 11 will appear as shown in FIGS. 1A and 1B immediately after engaging the stuck object with fishing tool 103. The operator then pulls some tension on the work string which is preferably coiled tubing 16. The amount of tension depends upon a number of factors including yield strength of the coiled tubing 16 and the type of stuck object. The operator may wish to begin with the maximum tension, then reduce that tension if it appears to be too much to allow jar 11 to fire. Alternately, the operator may begin with a low tension, then increase it. Assuming the first case, the maximum amount of tension should be a safe fraction of the yield strength of the coiled tubing 16, for example 80 percent. When pulling tension, mandrel 85 and housing 13 will not move, but adapter 15 will move from the neutral position shown in FIG. 1A to the operating position shown in FIG. 2.

The operator pumps hydraulic fluid, normally water, down coiled string 16 (FIG. 1). The fluid flows into bypass passage 25 and from there into entry passage 41. Shuttle valve 45 is shown in the lower position in FIGS. 2 and 3, directing the fluid to the upper portion of chamber 47. This starts shaft 37, along with pistons 35 and 61, to move downward in unison. During the downward stroke of this embodiment, only master piston 35 is operational. High pressure fluid on the upper side of chamber 47 does not communicate to the upper side of chamber 63. The lower portion of chamber 47 exhausts through port 53 and vent 51 into axial passage 39. The lower portion of chamber 63 exhausts through port 69, passage 54 and vent 51 into axial passage 39. The fluid in axial passage 39 flows out of the jar assembly 11 through firing pin passage 92 and mandrel passage 102.

Referring to FIG. 2, pins 73 will slide down firing pin 75, contact firing pin rib 77, and push rib 77 downward a short distance until reaching recess 79. At that point, spring 93 will push firing pin 75 upward relative to sleeve 71, resulting in pins 73 now being on the lower side of rib 77 as shown in FIG. 4. Pins 73 will be at the lower end of the stroke of shaft 37 when they reach recess 79. Shuttle valve 45 will shift at approximately that point to the upper position, as can be seen by comparing FIGS. 3 and 4. Shuttle valve 45 shifts because of the increased pressure of trapped fluid in the portion of upper chamber 47 between seal 58 in counterbore 57 being engaged by piston neck 59 and seal 36 on master piston 35. The pressure of the trapped fluid will be greater than the pressure in chamber 47 above piston seal 36.

Once shifted to the upper position, shuttle valve 45 now directs high pressure fluid pumped from the surface to the lower side of master piston 35 and slave piston 61. The lower portion of chamber 63 receives its hydraulic pressure via port 53, passage 54 and port 69. While on the upward stroke as shown in FIGS. 4 and 5, the upper portion of chamber 47 vents through port 49 while the upper portion of chamber 63 vents through port 67. In both cases, the fluid vents to axial passage 39. While pistons 35 and 61 move upward, firing pin 75 will also move upward through the bore restricted portion 72*a*. Because of the attachment of mandrel 85 to the stuck object, it cannot move upward, consequently, first, spring 93 will compress as can be seen by comparing FIG. 4 with FIGS. 5 and 6. The force to compress spring 93 is not high, because spring 93 is not used to deliver an impact. When firing pin shoulder 94 contacts mandrel flange 96, firing pin 75 cannot move any more upward, this position being shown in FIG. 5. Pistons 35, 61 however, are not yet at the upper ends of their strokes. Pistons 35, 61 cannot move any further upward relative to mandrel 85, consequently, the hydraulic pressure will now force housing 13 downward relative to pistons 35, 61, until housing lower end 101 is almost, but not in contact with lower anvil 99 as shown in FIG. 6. While housing 13 moves, coiled tubing 16 will stretch an increment as indicated by the arrow in FIG. 6. The amount of stretch should be well below the yield strength of the coiled tubing, thus this increment represents stored energy in the coiled tubing, similarly to a large spring. The operator will watch the weight indicator to make sure that this incremental tensioning does not exceed a safe fraction of the yield strength.

The next occurrence will be the firing of jar 11, which occurs once pins 73 reach enlarged bore area 72*b*, which is shown in FIG. 7. This happens before housing lower end 101 touches anvil 99. Pins 73 are cammed outward by rib 77, which once released, allows housing 11 to move back upward at a high rate of speed. Its upward facing hammer surface 97 will contact anvil 95 to deliver an upward directed blow. Coil spring 93 will be able to expand at that point, however it simply returns firing pin 75 to the neutral position relative to mandrel 85 and does not have any effect on the blow being delivered.

While and immediately after the blow is delivered, the continued hydraulic pressure on the lower sides of pistons 35, 61 moves them upward a short distance from the position shown in FIG. 7. Fluid is trapped in the upper portion of upper chamber 47 between seal 58 in counterbore 57 being engaged by piston neck 59 and seal 36 on piston 35. This increase in pressure causes directional valve 45 to move back to the lower position shown in FIG. 1. This directs fluid to start the pistons 35, 61 back downward for another stroke.

If the initial tension pulled by the operator was too high, then it is possible that the hydraulic pressure on pistons 35, 61 cannot move housing 13 downward the full amount from the position shown in FIG. 5 to that shown in FIG. 6. Pins 73 would not be able to reach enlarged bore area 72*b*, thus firing pin 75 cannot be released and jar 11 would not fire. The operator should reduce the amount of tension pulled on coiled tubing 16 incrementally until jar 11 fires, which can be detected by the weight indicator on the rig floor. If the tension was only enough to move control valve 19 to the operational position, jars 11 will fire, but the impact may be too low. While housing 13 moves downward from the position in FIG. 5 to that in FIG. 6, the effort to stretch coiled tubing 16 would be little because there would be very little tension in coiled tubing 16 at the beginning. The amount of energy delivered by the blow is proportional to the amount of energy that must be exerted by jar 11 when further tensioning the coiled tubing, consequently, the impact would likely be too low. The amount of impact can be determined by watching the difference in tension sensed by the weight indicator while jar 11 is fully cocked, as in FIG. 5, and just after the impact is delivered, in FIG. 6. If too low, the operator should apply more tension.

Downward Blow Operation

Figure 8:
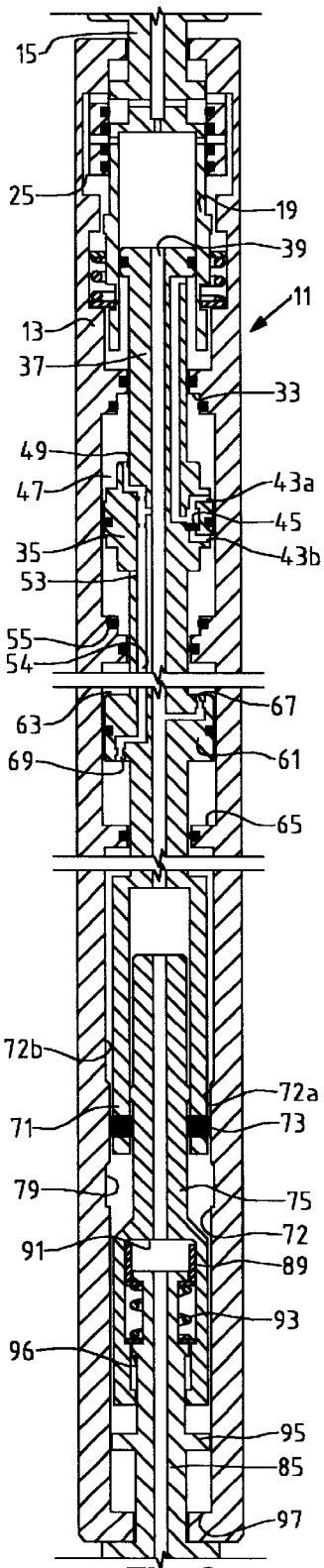
FIG. 8 is a sectional schematic view of the fishing jar of FIG. 1, showing the tool in a neutral position and in a configuration for delivering downward blows.
Figure 9:
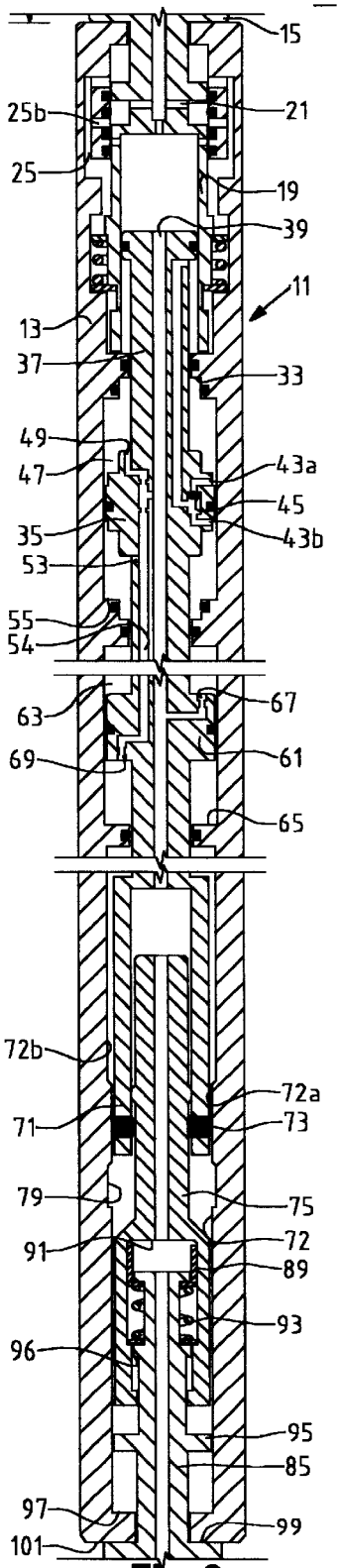
FIG. 9 is a view of the fishing jar similar to FIG. 8, showing the directional valve delivering hydraulic fluid pressure to the lower side of the piston to move the piston upward for cocking.

To deliver downward blows, rather than applying tension, the operator will apply compression as shown in FIG. 9. FIG. 8 represents a neutral position for downward blow deliveries. It resembles the neutral positions of FIGS. 1A and 1B, except that pins 73 are located below rib 77 instead of above. In both neutral positions of FIGS. 1A and 1B and FIG. 8, piston shaft 37 will not be moving and pistons 35, 61 may be in various positions relative to housing 13. Jar 11 will move from the position of FIGS. 1A and 1B to the position of FIG. 8 automatically merely by applying compression as shown in FIG. 9. When compression is applied, adapter 15 moves control valve 19 to the lower position, wherein upper passage 21 is aligned with lower bypass port 25*b*. If the shuttle valve 45 was in the position shown in FIG. 8 when compression and fluid pressure is applied, pistons 35, 61 will move downward a short distance until a high buildup of pressure occurs at directional valve 45 within lower portion of chamber 47. This causes valve 45 to shift to the upper position shown in FIG. 9, delivering high pressure fluid to below both pistons 35, 61.

Figure 10:
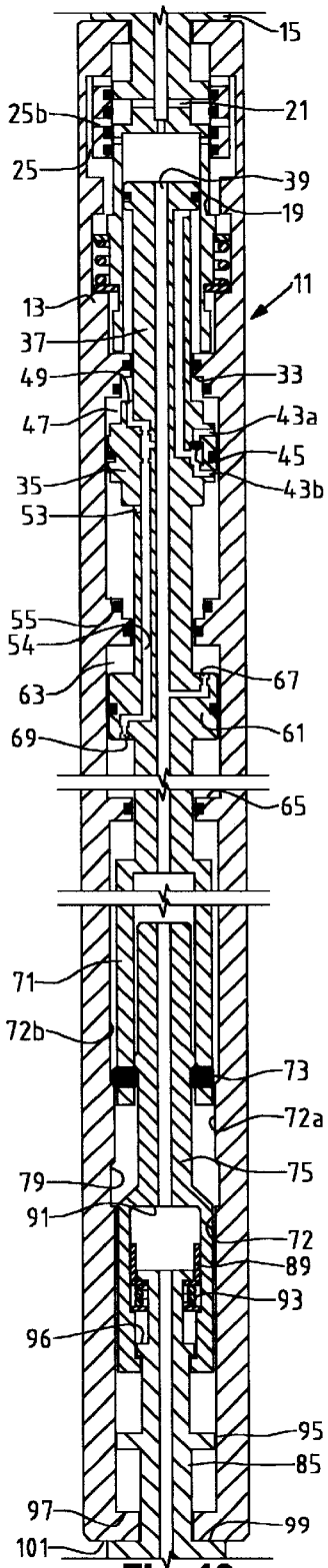
FIG. 10 is a view of the fishing jar similar to FIG. 9, showing the piston at its upper position.
Figure 11:
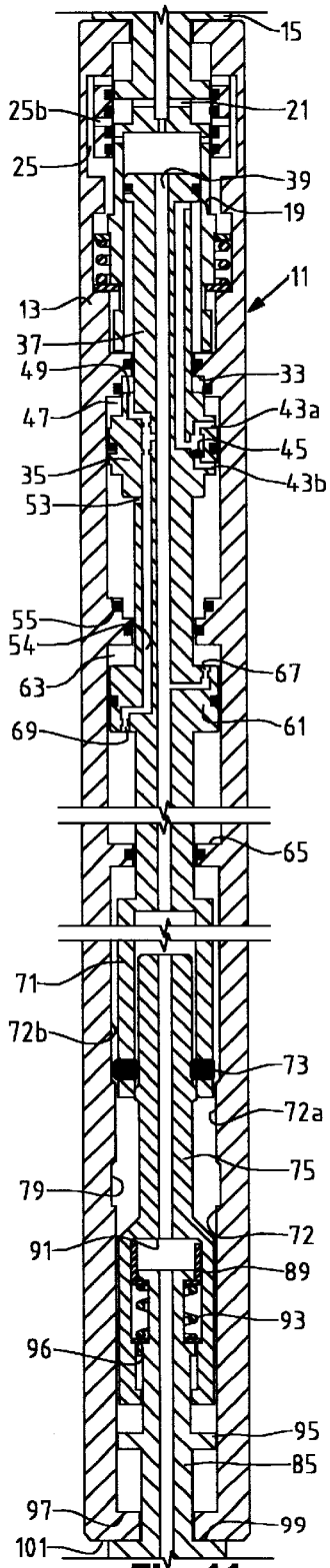
FIG. 11 is a view of the fishing jar similar to FIG. 10, showing directional fluid now being applied to push the piston downward along with the firing pin.

Referring to FIG. 10, piston 35 is nearing the end of its upward stroke in this view. Pin 73 will have engaged rib 77 and pulled firing pin 75 upward, compressing cocking spring 93. The upward movement of firing pin 75 stops when its flange 94 contacts mandrel flange 96. Pins 73 have now reached bore enlarged area 72*b*, allowing pins 73 to be cammed outward by downward movement of firing pin 75 due to cocking spring 93. Rib 77 will now be located below pins 73. At approximately the same time, directional valve 45 shifts to the lower position shown in FIG. 11 because piston 35 was at the upper end of the stroke. Fluid pressure now pushes piston 35 downward, but not piston 61 in this embodiment, which is not in operation on the downward stroke.

As shown in FIG. 12, further downward movement of firing pin 75 stops once the lower end of firing pins sleeve 83 contacts upper anvil 95. Pistons 35, 61 can no longer move relative to mandrel 85, causing the continued hydraulic pressure in upper chamber 47 to force housing 13 upward relative to mandrel 85. Housing 13 will move upward until its hammer surface 97 almost touches a lower side of mandrel upper anvil 95. The upward movement of housing 13 compresses coiled tubing 16 by the same increment, storing additional energy in the work string.

Once housing 13 reaches the upper end of its stroke, with housing surface 97 nearly touching mandrel upper anvil 95, pins 73 are free to move outward into recess 79, releasing engagement with firing pin 75. This allows the energy stored in the compressed work string to propel housing 13 downward, causing its lower hammer surface 101 to contact anvil 99 to deliver a downward blow shown in FIG. 13. Immediately afterward, continued movement of piston 35 downward relative to housing 13 will cause shuttle valve 45 to shift to the upper position shown in FIG. 14. This cycle will then repeat.

If, when one wishes to deliver downward blows, instead of the neutral position appearing as in FIG. 8, piston shaft 37 happens to locate as shown in FIGS. 1A and 1B, then pin 73 would be on the upper side of ribs 77, rather than the lower side. As previously mentioned, pin 73 can be moved to the lower side simply by applying compressive load as in FIG. 8 and pumping a liquid down coiled tubing 16. Jar 11 will cycle automatically to the position of FIG. 9.

Alternate Embodiment

FIGS. 15A–15D show an alternate embodiment with three pistons rather than two. Also, drawings 15A–15D are less schematic than the drawings of the first embodiment The numerals that are marked with a prime symbol correspond directly to the first embodiment and need not be discussed. In addition to those components, fishing jar 11' has a third or foot piston 105 located below piston 61'. Foot piston 105 is located below partition 65' and above a partition 107. This creates a third chamber 109 for piston 105 to reciprocate within. Piston 105 is constructed similarly to piston 61'. It has an entry port 111 for receiving fluid from the lower portion of chamber 109. It has a vent port 113 for receiving fluid from the upper portion of chamber 109. Fishing jar 11' operates in the same manner as fishing jar 11 of the first embodiment. Piston 105 will be functional and supply an additional force the same time that piston 61 supplied force.

This embodiment shows collet fingers 115 mounted to both the upper and lower sides of piston 105. Collet fingers 115 engage counterbores 117 formed in partitions 65' and 107 when piston 105 is at the top and bottom of its stroke. The engagement is frictional and does not restrict upward and downward strokes of piston 105. The frictional engagement is for holding shaft 37' in either the upper position or the lower position while jar 11' is turned off. This assures that the pistons don't end up in a stalled position when fluid pressure is initially applied. Collet fingers 115 could also be employed in the first embodiment on one of the pistons.

The invention has significant advantages. The jar allows high impacts to be delivered without having to reciprocate a work string up and down. This is particularly beneficial for coiled tubing strings. The jar is capable of delivering variable impacts due to the amount of tension or compression applied to the work string. The fishing tool needs no main spring of its own as it relies on the energy being stored in the work string to deliver the blows.

While the invention has been shown in only one of its forms, it should be apparent to those skilled in the art that it is not so limited but susceptible to various changes without departing from the scope of the invention. For example, the reciprocating pistons could be used for other purposes than delivering blows, such as operating as a downhole motor for reciprocation or rotary movement. An accelerating energy storage device could be coupled to the tool to augment the energy that will be stored by elastically deforming the coiled tubing string. Furthermore, the directional valve could be located in the housing rather than in the master piston.

Additionally, the jar could be inverted with the mandrel located at the upper end and connected to the string of conduit. The housing could connect to the stuck object and remain stationary while the mandrel moves up and down to deliver blows.

We claim:

1. A fishing jar for use in a well for engaging a stuck object in the well, comprising:

a tubular housing having a longitudinal axis and a hammer anvil interface, the housing adapted to be carried by a string of conduit;

a chamber in the housing having an entry port adapted to communicate with a passage extending through the conduit and an exhaust port leading to an exterior of the housing;

a mandrel carried in the housing, the mandrel and the housing being axially moveable relative to each other, the mandrel having a hammer anvil interface that is positioned for cooperative engagement with the hammer anvil interface of the housing;

a piston member carried in the chamber of the housing for axial movement relative to the housing and the mandrel;

a firing member in the housing that is engageable by the piston member when the piston member has moved toward the firing member a selected distance, and wherein after the piston member engages the firing member, the firing member applies a restrictive load against movement of the piston member in an opposite direction;

a directional valve in communication with the entry port of the chamber in the housing, the directional valve adapted to direct a flow of a fluid being pumped down the conduit to the chamber on one side of the piston member to move the piston member in the opposite direction, while the exhaust port of the chamber is adapted to vent the fluid on the opposite side of the piston to the exterior, wherein once the pressure of the fluid on the piston member reaches a sufficient level due to the restrictive load, the housing and mandrel will move relative to each other to a cocked position, separating their respective hammer anvil interfaces from each other and adapted to elastically deform the conduit in the well, thereby storing energy; wherein once the housing and the mandrel reach the cocked position, the firing member subsequently releases the piston member, which is adapted to allow the energy stored in the conduit to rapidly move the hammer anvil interfaces of the housing and the mandrel into engagement with each other; and wherein the firing member comprises:

a firing pin in engagement with the mandrel and having a sidewall with an external rib; and wherein the piston member comprises:

a piston and a piston extension, the piston extension having a cylindrical wall that slides over the firing pin and has a plurality of pins carried in the cylindrical wall that interferingly engage the rib on the firing pin to create the restrictive load, and wherein the pins on the piston extension will slide by the rib on the firing pin after the housing has deformed the conduit.

2. The fishing jar according to claim 1, wherein the pins are free to move in the cylindrical wall in inward and outward directions perpendicular to the axis, and wherein the housing has a first recess located therein that enables the pins to slide outward and over the to engage the piston member with the firing pin when the piston member has moved in the housing the selected distance toward the firing pin member, and a second recess to enable the pins to slide outward and over the rib after the piston member has moved in the opposite direction a selected distance.

3. The fishing jar according to claim 2, further comprising:

a spring mounted between the firing pin and the mandrel, the spring allowing limited axial movement of the firing pin in unison with the piston member and biasing the firing pin to a neutral position relative to the mandrel.

4. A fishing jar for use in a well, for engaging a stuck object in the well, the jar comprising:

a tubular housing having a longitudinal axis and a hammer anvil interface, the housing adapted to be carried by a string of conduit;

a mandrel carried in the housing, the mandrel and the housing being axially moveable relative to each other, the mandrel having a hammer anvil interface that is positioned for cooperative engagement with the hammer anvil interface of the housing;

a piston member carried in the housing for axial movement relative to the housing and the mandrel;

a firing member in the housing that is engageable by the piston member when the piston member has moved toward the firing member a selected distance, and wherein after the piston member engages the firing member, the firing member applies a restrictive load against movement of the piston member in an opposite direction;

a directional valve in the housing adapted to direct a flow of a fluid being pumped down the conduit to move the piston member in the opposite direction, wherein once the pressure of the fluid on the piston member reaches a sufficient level due to the restrictive load, the housing and mandrel will move relative to each other to a cocked position, separating their respective hammer anvil interfaces from each other and adapted to elastically deform the conduit in the well, thereby storing energy; wherein once the housing and the mandrel reach the cocked position, the firing member subsequently releases the piston member, which is adapted to allow the energy stored in the conduit to rapidly move the hammer anvil interfaces of the housing and the mandrel into engagement with each other; and a control valve in the housing that is adapted to operate in response to tension being applied to the housing by pulling on the conduit to direct fluid being pumped down the conduit to the directional valve.

5. The fishing jar according to claim 4, wherein the control valve also is adapted to operate in response to compression being applied by weight of the conduit to direct fluid being pumped down the conduit to the directional valve.

6. A fishing assembly for use in a well, comprising:

a string of tubing for lowering into the well;

a tubular housing having a longitudinal axis and a hammer surface, the housing having an upper end carried by the string of tubing;

a chamber in the housing having an entry port in communication with an interior of the string of tubing;

a mandrel carried in the housing for axial movement relative to the housing and having a lower end adapted to be engaged with a stuck object in the well, the mandrel having an anvil thereon that is positioned for impact by the hammer surface of the housing;

a piston carried in the chamber for stroking movement relative to the housing and the mandrel in upper and lower directions, the piston having upper and lower sides and having a piston extension extending below and movable with the piston;

a firing member in the housing that is engageable by the piston extension when the piston has moved downward in the housing to a selected lower point along a stroke of the piston, the firing member applying a restrictive load to upward movement of the piston extension and piston after engagement;

a directional valve in communication with the entry port, having a first position for directing flow of fluid being pumped down the string of tubing into the chamber on the upper side of the piston, moving the piston in the downward direction to cause the piston extension to engage the firing member, and a second position occurring after the piston extension has engaged the firing member, for directing flow of fluid being pumped down the string of tubing into the chamber on the lower side of the piston to cause movement of the piston in the upward direction, wherein once the pressure of the fluid on the lower side of the piston reaches a sufficient level, the housing will move downward relative to the mandrel to stretch the string of tubing, thereby storing energy;

the firing member subsequently releasing the piston extension at a selected upper point along the stroke, which allows the stored energy of the string of tubing to rapidly move the housing upward, causing its hammer surface to strike the anvil; and wherein the directional valve subsequently directs the flow of fluid being pumped down the string of tubing to move the piston back downward to return the piston extension back into engagement with the firing member.

7. The fishing assembly according to claim 6, wherein the directional valve operates in response to pressure in the chamber.

8. A fishing assembly for use in a well, comprising:

a string of tubing for lowering into the well;

a tubular housing having a longitudinal axis and a hammer surface, the housing having an upper end connected to the string of tubing;

a mandrel carried in the housing for axial movement relative to the housing and having a lower end adapted to be engaged with a stuck object in the well, the mandrel having an anvil thereon that is positioned for impact by the hammer surface of the housing;

a piston carried in the housing for stroking movement relative to the housing and the mandrel in upper and lower directions, the piston having upper and lower sides and having a piston extension extending below and movable with the piston;

a firing member in the housing that is engageable by the piston extension when the piston has moved downward in the housing to a selected lower point along a stroke of the piston, the firing member applying a restrictive load to upward movement of the piston extension and piston after engagement;

a directional valve in the housing, having a first position for directing flow of fluid being pumped down the string of tubing to the upper side of the piston, moving the piston in the downward direction to cause the piston extension to engage the firing member, and a second position occurring after the piston extension has engaged the firing member, for directing flow of fluid being pumped down the string of tubing to the lower side ofthe piston to cause movement of the piston in the upward direction, wherein once the pressure of the fluid on the lower side of the piston reaches a sufficient level, the housing will move downward relative to the mandrel to stretch the string of tubing, thereby storing energy;

the firing member subsequently releasing the piston extension at a selected upper point along the stroke, which allows the stored energy of the string of tubing to rapidly move the housing upward, causing its hammer surface to strike the anvil; wherein the directional valve subsequently directs the flow of fluid being pumped down the string of tubing to move the piston back downward to return the piston extension back into engagement with the firing member; wherein the firing member comprises:

a firing pin in engagement with the mandrel and being movable between upper and lower positions relative to the mandrel, the firing pin having a sidewall with a protuberance;

a spring between the firing pin and the mandrel that urges the firing pin to a neutral position between the upper and lower positions; and wherein the piston extension telescopingly engages the firing pin and has a protuberance that slides past and interferingly engages the protuberance on the firing pin at the lower point along the stroke to cause the firing pin to move upward to the upper position with the piston extension, creating the restrictive load when at the upper position, and wherein the protuberance on the piston extension will slide by the protuberance on the firing pin when the upper point along the stroke is reached.

9. The fishing assembly according to claim 8 wherein a lower recess is located in the housing at the lower point along the stroke and an upper recess is located in the housing at the upper point along the stroke.

10. A fishing assembly for use in a well, comprising:

a string of tubing for lowering into the well;

a tubular housing having a longitudinal axis and a hammer surface, the housing having an upper end connected to the string of tubing;

a mandrel carried in the housing for axial movement relative to the housing and having a lower end adapted to be engaged with a stuck object in the well, the mandrel having an anvil thereon that is positioned for impact by the hammer surface of the housing;

a piston carried in the housing for stroking movement relative to the housing and the mandrel in upper and lower directions, the piston having upper and lower sides and having a piston extension extending below and movable with the piston;

a firing member in the housing that is engageable by the piston extension when the piston has moved downward in the housing to a selected lower point along a stroke of the piston, the firing member applying a restrictive load to upward movement of the piston extension and piston after engagement;

a directional valve in the housing, having a first position for directing flow of fluid being pumped down the string of tubing to the upper side of the piston, moving the piston in the downward direction to cause the piston extension to engage the firing member, and a second position occurring after the piston extension has engaged the firing member, for directing flow of fluid being pumped down the string of tubing to the lower side of the piston to cause movement of the piston in the upward direction, wherein once the pressure of the fluid on the lower side of the piston reaches a sufficient level, the housing will move downward relative to the mandrel to stretch the string of tubing, thereby storing energy;

the firing member subsequently releasing the piston extension at a selected upper point along the stroke, which allows the stored energy of the string of tubing to rapidly move the housing upward, causing its hammer surface to strike the anvil; wherein the directional valve subsequently directs the flow of fluid being pumped down the string of tubing to move the piston back downward to return the piston extension back into engagement with the firing member; wherein a lower recess is located in the housing at the lower point along the stroke and an upper recess is located in the housing at the upper point along the stroke, and wherein the firing member comprises:

a firing pin in engagement with the mandrel and being movable between upper and lower positions relative to the mandrel, the firing pin having a sidewall with an external rib;

a spring between the firing pin and the mandrel that urges the firing pin to a neutral position between the upper and lower positions; and wherein the piston extension slides over the firing pin and has a plurality of pins that are radially movable, slide past and interferingly engage the rib on the firing pin at the lower recess to cause the firing pin to move upward to the upper position with upward movement of the piston extension, compressing the spring and creating the restrictive load when at the upper position, and wherein the pins on the piston extension slide by the rib on the firing pin when at the upper recess.

11. A fishing assembly for use in a well, comprising:

a string of tubing for lowering into the well;

a tubular housing having a longitudinal axis and a hammer surface, the housing having an upper end connected to the string of tubing;

a mandrel carried in the housing for axial movement relative to the housing and having a lower end adapted to be engaged with a stuck object in the well, the mandrel having an anvil thereon that is positioned for impact by the hammer surface of the housing;

a piston carried in the housing for stroking movement relative to the housing and the mandrel in upper and lower directions, the piston having upper and lower sides and having a piston extension extending below and movable with the piston;

a firing member in the housing that is engageable by the piston extension when the piston has moved downward in the housing to a selected lower point along a stroke of the piston, the firing member applying a restrictive load to upward movement of the piston extension and piston after engagement;

a directional valve in the housing, having a first position for directing flow of fluid being pumped down the string of tubing to the upper side of the piston, moving the piston in the downward direction to cause the piston extension to engage the firing member, and a second position occurring after the piston extension has engaged the firing member, for directing flow of fluid being pumped down the string of tubing to the lower side ofthe piston to cause movement of the piston in the upward direction, wherein once the pressure of the fluid on the lower side of the piston reaches a sufficient level, the housing will move downward relative to the mandrel to stretch the string of tubing, thereby storing energy;

the firing member subsequently releasing the piston extension at a selected upper point along the stroke, which allows the stored energy ofthe string of tubing to rapidly move the housing upward, causing its hammer surface to strike the anvil; wherein the directional valve subsequently directs the flow of fluid being pumped down the string of tubing to move the piston back downward to return the piston extension back into engagement with the firing member; wherein the fishing assembly further comprises:

a control valve in the housing that operates in response to tension being applied to the housing by pulling on the string of tubing to direct fluid being pumped down the string of tubing to the directional valve.

12. A fishing assembly for use in a well, comprising:

a string of tubing for lowering into the well;

a tubular housing having a longitudinal axis and an upward facing hammer surface and a downward facing hammer surface, the housing having an upper end connected to the string of tubing;

a mandrel carried in the housing for axial movement relative to the housing and having a lower end adapted to be engaged with a stuck object in the well, the mandrel having an anvil thereon with a downward facing anvil surface that is positioned for impact by the upward facing hammer surface of the housing and an upward facing anvil surface that is positioned for impact by the downward facing hammer surface of the housing;

a piston carried in the housing for stroking movement relative to the housing and the mandrel in upper and lower directions, the piston having upper and lower sides and having a piston extension extending below and movable with the piston;

a firing member in the housing that is engageable by the piston extension when the piston has moved downward in the housing to a selected lower point along a stroke of the piston, the firing member applying a restrictive load to upward movement of the piston extension and piston after engagement;

a directional valve in the housing, having a first position for directing flow of fluid being pumped down the string of tubing to the upper side of the piston, moving the piston in the downward direction to cause the piston extension to engage the firing member, and a second position occurring after the piston extension has engaged the firing member, for directing flow of fluid being pumped down the string of tubing to the lower side of the piston to cause movement of the piston in the upward direction, wherein once the pressure of the fluid on the lower side of the piston reaches a sufficient level, the housing will move downward relative to the mandrel to stretch the string of tubing, thereby storing energy;

the firing member subsequently releasing the piston extension at a selected upper point along the stroke, which allows the stored energy of the string of tubing to rapidly move the housing upward, causing its upward facing hammer surface to strike the downward facing anvil surface; wherein the directional valve subsequently directs the flow of fluid being pumped down the string of tubing to move the piston back downward to return the piston extension back into engagement with the firing member;

a control valve in the housing that operates in response to compression being applied to the housing by weight of the string of tubing to direct fluid being pumped down the string of tubing to the directional valve to move the piston from a lower position upward to engage the piston extension with the firing member at the upper point along the stroke; wherein the directional valve in the housing subsequently directs fluid being pumped down the string of tubing to move the piston back downward and move the housing upward relative to the mandrel, applying further compression to the string of tubing to store energy; and wherein firing member subsequently releases the piston extension at the lower point along the stroke, causing the stored energy to move the housing downward rapidly to deliver the upward facing anvil surface a blow with the downward facing hammer surface.

13. In a fishing assembly for use in a well, the fishing assembly having a string of conduit and a device for engaging a stuck object in the well, the improvement comprising:

a tubular housing having a longitudinal axis and a hammer anvil interface;

a mandrel carried in the housing, the mandrel and the housing being axially moveable relative to each other, the mandrel having a hammer anvil interface that is positioned for cooperative engagement with the hammer anvil interface of the housing;

a piston member having a piston carried in the housing for axial movement relative to the housing and the mandrel;

a firing member in the housing that is engageable by the piston member when the piston member has moved toward the firing member a selected distance, and wherein after the piston member engages the firing member, the firing member applies a restrictive load against movement of the piston member in an opposite direction;

upper and lower partitions in the housing that define a chamber containing the piston, the chamber and the piston defining an upper trapped fluid portion between the piston and the upper partition, and a lower trapped fluid portion between the piston and the lower partition, the chamber having an entry port in communication with an interior of the conduit;

a shuttle valve mounted in the piston in communication with the entry port of the chamber, having a first position operable in response to pressure increase in the upper trapped fluid portion of the chamber for directing a flow of fluid being pumped down the conduit to the chamber on an upper side of the piston, moving the piston downward, and a second position operable in response to pressure increase in the lower trapped fluid portion of the chamber, for directing the flow of fluid being pumped down the conduit to the chamber on a lower side of the piston to move the piston upward; wherein once the pressure of the fluid operating against the piston reaches a sufficient level, the housing and mandrel will move relative to each other to a cocked position, separating their respective hammer anvil interfaces from each other and elastically deforming the conduit in the well, thereby storing energy; and wherein once the housing and the mandrel reach the cocked position, the firing member subsequently releases the piston member, which allows the energy stored in the conduit to rapidly move the hammer anvil interfaces of the housing and the mandrel into engagement with each other.

14. The fishing assembly according to claim 13, further comprising:

a control valve in the housing that operates in response to tension being applied to the housing by pulling on the conduit to direct the fluid being pumped down the conduit to the shuttle valve to move the piston member downward to engage the piston member with the firing member; wherein in response to the pressure increase in the lower trapped fluid portion ofthe chamber, the shuttle valve subsequently directs the fluid being pumped down the conduit to move the piston upward and move the housing and the mandrel to the cocked position, applying further tension to the conduit to store energy, and wherein when the firing member subsequently releases the piston member, the stored energy delivers an upward directed blow to the hammer anvil interface on the mandrel.

15. The fishing assembly according to claim 13, further comprising:

a control valve in the housing that operates in response to compression being applied to the housing by weight of the conduit to direct the fluid being pumped down the conduit to the shuttle valve to move the piston upward to engage the piston member with the firing member; wherein in response to the pressure increase in the upper portion of the chamber, the shuttle valve subsequently directs the fluid being pumped down the conduit to move the piston downward and move the housing and the mandrel to the cocked position, applying further compression to the conduit to store energy; and wherein when the firing member subsequently releases the piston member, the stored energy delivers a downward blow at the hammer anvil interface on the mandrel.

16. The assembly according to claim 13, wherein the piston member comprises a plurality of pistons, each located one above the other in the housing and secured together for movement in unison.

17. A method of jarring a stuck object in a well, comprising:

(a) providing a jar assembly with a housing with a hammer anvil interface;

(b) mounting in the housing a mandrel, a piston member, and a firing member in the housing that is engageable by the piston member, the mandrel having a hammer anvil interface;

(c) securing the jar assembly to a string of conduit, lowering the jar into the well and engaging the stuck object with the jar assembly;

(d) applying tension to the conduit to stretch the conduit and pumping fluid down the conduit, causing the piston member to move to an engaged position with the firing member; then (e) directing the fluid being pumped down the conduit to cause the piston member to move in an opposite direction, and resisting the movement of the piston member in the opposite direction by restrictive engagement with the firing member, causing the housing and mandrel to move to a cocked position and further stretching the conduit in the well, thereby storing energy; then (f) releasing the piston member from restrictive engagement with the firing member, allowing the energy stored in the conduit to rapidly move the housing and the mandrel to an extended position, causing the hammer anvil interfaces to strike each other to deliver a jarring shock to the stuck object.

18. The method according to claim 17, further comprising:

after step (f), again causing the piston member to move downward and repeating steps (e) and (f).

19. The method according to claim 17, further comprising and after step (f):

positioning the piston member in a lower position relative to the firing member;

applying compression to the housing with the conduit;

directing the fluid being pumped down the conduit to move the piston upward into restrictive engagement with the firing member; then directing the fluid being pumped down the conduit to move the piston downward while being resisted by the restrictive engagement with the firing member, causing the housing to move upward relative to the mandrel and flier compressing the conduit, thereby storing compression energy; then releasing the piston member from the restrictive engagement with the firing member, thereby driving the housing downward relative to the mandrel with the stored compression energy and delivering a blow to hammer anvil interface of the mandrel with the hammer anvil interface of the housing.

20. In a well having a string of conduit, a well tool, the improvement comprising:

a tubular housing carried by the conduit, the housing having a longitudinal axis having a chamber with an entry section for receiving well fluid pumped down the conduit;

a piston carried in the chamber for stroking movement relative to the housing in upward and downward directions, the piston having upper and lower sides and a directional passage that communicates fluid in the chamber between the upper and lower sides;

a central shaft extending axially from the piston in the first direction, the shaft having an entry flow passage that communicates with the entry section to receive the fluid being pumped down the conduit, the entry flow passage leading to the directional passage;

the chamber being defined by upper and lower partitions in the housing, the chamber having an upper portion between the piston and the upper partition, and a lower portion between the piston and the lower partition; and a shuttle valve mounted in the directional passage and traveling with the piston, the shuttle valve having a first position operable in response to pressure increase in the upper portion of the chamber as the piston nears the upper partition for directing the flow of fluid being pumped down the entry passage from the conduit to the upper side of the piston, moving the piston in the downward direction, and a second position operable in response to pressure increase in the lower portion of the chamber as the piston nears the lower partition, for directing flow of fluid being pumped down the entry passage from the conduit to the lower side of the piston to cause movement of the piston in the upward direction.

21. The well tool according to claim 20, wherein the piston has a vent that bleeds a portion of the fluid in the chamber through a restrictive orifice into a central bore of the shaft.

22. A well tool, comprising:

a string of conduit;

a tubular housing carried by the string of conduit, the housing having a longitudinal axis having an entry section for receiving well fluid pumped down the conduit;

a piston carried in the housing for stroking movement relative to the housing in upward and downward directions,-the piston having upper and lower sides and a directional passage that communicates between the upper and lower sides;

a central shaft extending axially from the piston in the first direction, the shaft having an entry flow passage that communicates with the entry section to receive the fluid being pumped down the conduit, the entry flow passage leading to the directional passage;

upper and lower partitions in the housing that define a chamber containing the piston, the chamber having an upper portion between the piston and the upper partition, and a lower portion between the piston and the lower partition;

a shuttle valve mounted in the directional passage and traveling with the piston, the shuttle valve having a first position operable in response to pressure increase in the upper portion of the chamber as the piston nears the upper partition for directing flow of fluid being pumped down the entry passage to the upper side of the piston, moving the piston in the downward direction, and a second position operable in response to pressure increase in the lower portion of the chamber as the piston nears the lower partition, for directing flow of fluid being pumped down the entry passage to the lower side of the piston to cause movement of the piston in the upward direction;

an exhaust passage extending through the shaft for communicating fluid therein exterior of the housing;

a lower vent passage between the shaft and the exhaust passage for venting fluid from the lower portion of the chamber while the directional valve is in the first position;

an upper vent passage between the shaft and the exhaust passage for venting fluid from the upper portion of the chamber while the directional valve is in the second position; and wherein the upper and lower partitions and the piston define an upper and lower trapped fluid areas that exist while the piston is near the upper and lower partitions, respectively, the upper and lower trapped fluid areas being blocked from communication with the upper and lower vents so as to allow said pressure increases.

23. The well tool according to claim 22, further comprising a control valve in the entry section of the chamber that controls flow to the entry passage in the shaft, the control valve being movable between an upper position when selected tension is applied to the housing to a neutral position when the selected tension is removed, one of the positions of the control valve opening the flow of fluid to the entry passage, the other closing the flow of fluid to the entry passage and opening flow to the exhaust passage.

24. A well tool, comprising:

a string of conduit;

a tubular housing carried by the string of conduit, the housing having a longitudinal axis having an entry section for receiving well fluid pumped down the conduit;

a piston carried in the housing for stroking movement relative to the housing in upward and downward directions, the piston having upper and lower sides and a directional passage that communicates between the upper and lower sides;

a central shaft extending axially from the piston in the first direction, the shaft having an entry flow passage that communicates with the entry section to receive the fluid being pumped down the conduit, the entry flow passage leading to the directional passage;

upper and lower partitions in the housing that define a chamber containing the piston, the chamber having an upper portion between the piston and the upper partition, and a lower portion between the piston and the lower partition;

a shuttle valve mounted in the directional passage and traveling with the piston, the shuttle valve having a first position operable in response to pressure increase in the upper portion of the chamber as the piston nears the upper partition for directing flow of fluid being pumped down the entry passage to the upper side of the piston, moving the piston in the downward direction, and a second position operable in response to pressure increase in the lower portion of the chamber as the piston nears the lower partition, for directing flow of fluid being pumped down the entry passage to the lower side of the piston to cause movement of the piston in the upward direction;

a control valve in the entry section of the housing that controls flow to the entry passage in the shaft, the control valve being movable between an upper position when selected tension is applied the housing to- a neutral position when the selected tension is removed, one of the positions of the control valve opening the passage of fluid to the entry passage, the other position closing the flow of fluid to the entry passage.

25. A well tool, comprising:

a string of conduit;

a tubular housing carried by the string of conduit, the housing having a longitudinal axis having an entry section for receiving well fluid pumped down the conduit;

a piston carried in the housing for stroking movement relative to the housing in upward and downward directions, the piston having upper and lower sides and a directional passage that communicates between the upper and lower sides;

a central shaft extending axially from the piston in the first direction, the shaft having an entry flow passage that communicates with the entry section to receive the fluid being pumped down the conduit, the entry flow passage leading to the directional passage;

upper and lower partitions in the housing that define a chamber containing the piston, the chamber having an upper portion between the piston and the upper partition, and a lower portion between the piston and the lower partition;

a shuttle valve mounted in the directional passage and traveling with the piston, the shuttle valve having a first position operable in response to pressure increase in the upper portion of the chamber as the piston nears the upper partition for directing flow of fluid being pumped down the entry passage to the upper side of the piston, moving the piston in the downward direction, and a second position operable in response to pressure increase in the lower portion of the chamber as the piston nears the lower partition, for directing flow of fluid being pumped down the entry passage to the lower side of the piston to cause movement of the piston in the upward direction; and a control valve in the entry section of the housing that controls flow to the entry passage in the shaft, the control valve being movable between an upper position when selected tension is applied the housing to a neutral position when the selected tension is removed, and to a lower position when compression is applied to the housing, the tension and compression positions ofthe control valve opening the flow of fluid to the entry passage, and the neutral position closing the flow of fluid to the entry passage.

* * * * *